United States Patent [19]

Maeda et al.

[11] Patent Number: 4,677,934

[45] Date of Patent: Jul. 7, 1987

[54] COATING DEVICE FOR COLD BOTTLES OR LIKE CONTAINERS

[75] Inventors: Hironobu Maeda; Seizaburo Kitahara; Haruo Yosimura; Takao Torawaki; Takasi Yaegasi; Isao Yamaoka, all of Sapporo, Japan

[73] Assignee: Sapporo Breweries, Ltd., Japan

[21] Appl. No.: 888,782

[22] Filed: Jul. 21, 1986

[51] Int. Cl.[4] ..... B05C 1/02; B05C 11/00

[52] U.S. Cl. ..... 118/58; 118/219; 118/239; 118/262

[58] Field of Search ..... 118/219, 232, 239, 218, 118/225, 248, 259, 58, 69, 262

[56] References Cited

U.S. PATENT DOCUMENTS 2,206,964 7/1940 Kimball et al. ..... 118/232 X 4,275,097 6/1981 Shriver ..... 118/219 X

*Primary Examiner*—John P. McIntosh

*Attorney, Agent, or Firm*—McGlew and Tuttle

[57] ABSTRACT

Cold bottles or other containers are transported by a conveyer, and, while being translated, the containers are rotated by a drive belt provided on one side of a line containers. Air is sprayed and coating fluid is applied on other side of the line of containers. Coating fluid is applied onto the containers by fluid application rolls at two levels having axes parallel to the direction of translation of containers. Coating fluid is supplied from spray nozzles to the fluid application rolls through sponge rolls contacting the fluid application rolls.

5 Claims, 4 Drawing Figures

COATING DEVICE FOR COLD BOTTLES OR LIKE CONTAINERS

BACKGROUND OF THE INVENTION

1. Field of the Invention

The invention relates to a coating device for applying coating to predetermined portions of a bottle or like container, and, in particularly, to a coating device suitable for a bottle or like container which is wetted or has dew condensed at low bottle temperatures.

2. Description of the Prior Art

Normally, when bottles of beer or 'Sake' or like containers are charged with their contents, dew is condensed on the surfaces of the containers if the contents are at low temperature. The surfaces of containers may be wetted with water for rinsing the containers. When the container surface is under such wet condition as this, it is not adequate to apply coating to a predetermined portion of a bottle, so that coating has been conventionally performed after the bottle surface was dried by raising the temperature of the bottle by means of hot water shower poured thereover or the like.

But the technique of prior art such as above has a disadvantage in that it requires provision of hot water shower and energy for raising temperature of water, thereby increasing the overall cost for bottling.

BRIEF SUMMARY OF THE INVENTION

It is an object of the invention to solve the problem of the prior art described above by providing a coating device of improved construction of cold bottles or like containers, wherein a bottle-rotating means is provided on one side of a line of cold bottles or like containers which are running on a conveyer, an air spraying and coating fluid applying stations are sequentially disposed on other side of the line of containers, compressed air jet nozzles are disposed on at least two levels at the air spraying station, the jet nozzles being directed to predetermined coating portions of the containers, and coating fluid application rolls are disposed on at least two levels at the coating fluid applying station, the application rolls being rotated about axes parallel to the direction of transportation of the cold bottles or like containers and in contact with the containers, the application rolls being supplied with coating fluid transferred from a spray nozzle through sponge rolls which rotate in contact with the application rolls.

DETAILED DESCRIPTION OF THE INVENTION

Figure 1:
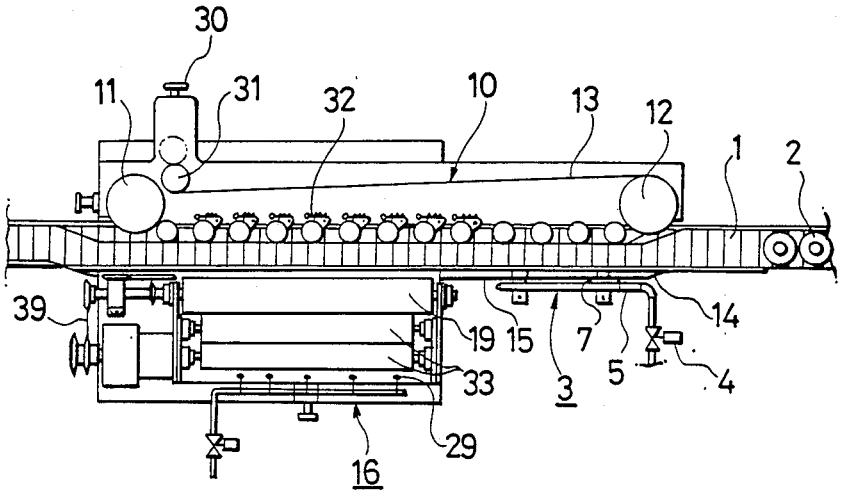
FIG. 1 is a plan view of an embodiment of the invention.
Figure 2:
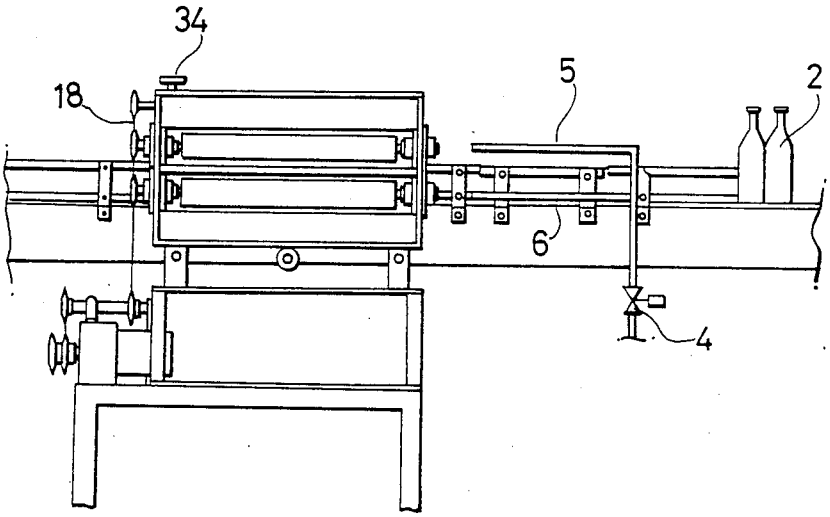
FIG. 2 is an elevation of the embodiment in FIG. 1.
Figure 3:
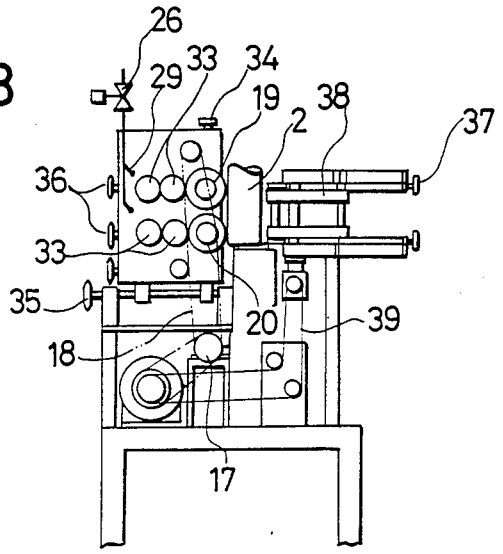
FIG. 3 is a left side view of the embodiment in FIG. 1.

Now the invention will be described hereunder, by way of an example, with reference to the accompanying drawings, in which FIG. 1 shows a plan view of an example of coating device for cool bottles or like containers, FIG. 2 shows an elevation of the device shown in FIG. 1, and FIG. 3 shows a left side view of the device shown in FIG. 1.

Bottles 2 which are transported by a conveyer 1 move in the direction from right to left in FIG. 1 and reach an air spraying station 3. Compressed air is supplied through a regulator valve 6 to an upper air tube 5 and lower air tube 6 having respectively board nozzle openings 7,7 which are directed to predetermined portions vulnerable to abrasion in the upper and lower parts of the bottles, thereby compressed air being continuously sprayed thereover. Therefore, the portions of bottles to be coated have water droplets dispersed and are brought from moist to dry state. A line of bottles 2 being transported by the conveyer 1 to the air spraying station 3 are translated on the conveyer 1 while being rotated by a bottle rotating means 10, this also being the case with the succeeding coating process. The bottle rotating means comprises a bottle driving belt 13 turning around a drive wheel 11 and a driven wheel 12, the bottle driving belt 13 defining a travelling surface which is parallel to the transporting path of the conveyer 1. The bottle driving belt 13 travels parallelly to the transporting path of the conveyer while being in contact with the line of bottles 2 so that the bottles 2 are rendered to rotate on their axes on the conveyer path due to the difference in the speed of the conveyer 1 and the bottle driving belt 13. In this process the bottles are repositioned so that about one third ($\frac{1}{3}$) of the bottom portion of a bottle protrudes from the transporting path. The line of bottles 2 are held from falling by a bottle guide rail 14 at the air spraying station and a bottle guide rail 15 succeeding thereto.

As described above, the line of bottles, from which moisture on their surface is removed at the air spraying station 3, proceed to the coating fluid applying station 16 while rotating on their axes on the conveyer 1 by the action of the bottle rotating means 10. In the coating fluid applying station 16 are provided an upper felt roll 19 and a lower felt roll which are both rotatingly driven by a felt roll drive chain, which, in turn, is driven by a prime mover 17. The upper and lower felt rolls 19 and 20 are contacting with the predetermined portions in the upper and lower parts of each bottle 2 respectively. Additional felt rolls may be provided for other portions of a bottle if required.

Figure 4:
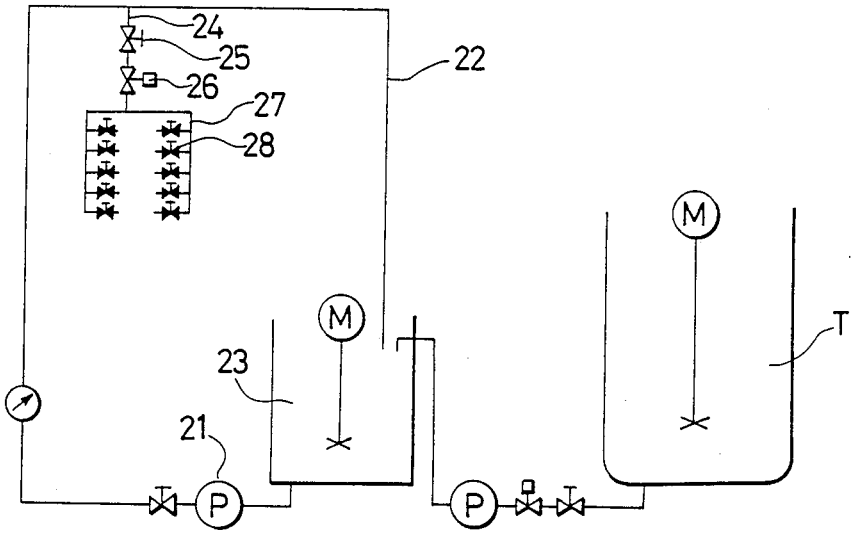
FIG. 4 shows a flow chart of coating fluid supply system of the device shown in FIG. 1

Referring to FIG. 4 showing the flow chart of coating fluid supply system, coating fluid is pressurized by a supply pump 21 and returns, through a recirculating line 22, to a fluid tank 23. Meantime, the coating fluid is routed from the recirculating line 22, through a coating fluid feed line 24, manual valve 25 and solenoid valve 26, to coating fluid supply headers 27. The coating fluid supply header 27 communicates with plurality of spray nozzles 29 each of which is provided with a fluid flow regulator valve 28 and sprays coating fluid out of its tip. Further, in FIG. 4, M represents fluid mixer motors, T a coating fluid storage tank, P supply pumps.

Position and tension of the bottle driving belt 13 are adjusted by a bottle driving belt-contact surface adjustment roll 31 which is displaced by a bottle driving belt adjustment handle 30 mounted to the frame of conveyer.

Over the whole length of the felt rolls are disposed bottle driving belt pressing rolls 32 of smaller-than-bottle diameter having springs, tension of which can be automatically adjusted depending on resiliency of the upper and lower felt rolls 19 and 20 so that the bottles are pushed against the felt rolls under uniform pressure. The felt roll consists of felt plates cut in circular discs and stacked in a cylindrical shape, and can yield good elasticity and contactability through its compressed peripheral surface, thereby exerting excellent coating effect.

Referring to FIG. 3 showing the left side view of the device in FIG. 2, coating fluid is injected from spray nozzles 29 to the outermost portions of sponge rolls 33, two of which are provided for each of upper and lower use, when a solenoid valve 26 is let open by the actuation of a timer. Since the sponge rolls for upper use are in contact with and rotatingly driven by the upper felt roll 19 and the sponge rolls for lower use are in contact with and rotatingly driven by the lower roll 20, coating fluid injected onto the outermost sponge rolls 33 as described above is transferred through the co-rotating sponge rolls 33 to the co-rotating felt rolls 19,20, and thenafter rubbed onto the predetermined portions of the surfaces of bottles 2.

For adjusting the level of portion to be coated, the level of the upper felt roll 19 can be changed through the use of felt roll level adjustment handle 34 which is mounted to the frame of coating device. Further, pressure of the felt rolls against bottles can be adjusted by moving the felt rolls back and forth through an adjustment handle 35 provided on the frame of coating device. Precise adjustment of the same pressure can be made by individually and precisely moving the upper and lower felt rolls back and forth through precise adjustment handles 36. In FIG. 3, the reference number 39 represents a bottle driving belt drive chain, 37 bottle drive adjustment handles, 38 bottle driving belt-contacting surface adjustment wheel, and 18 a felt roll drive chain.

Thus, according to the invention, the amount of coating fluid to be applied can be easily controlled by the timer through the solenoid valve, uniform coating is made possible by providing dual arrangement of sponge rolls, the air spraying means can immediately dry up, without necessity for any hot water shower, moist bottle surfaces caused by rinsing water or dew condensation due to cold bottle contents, so that saving in energy, consequential reduction in product cost and other remarkable effects are achieved.

Since it is understood that widely varied modes of carrying out the invention can be constructed without departing from the spirit and scope of the invention, the invention is not limited to the specific embodiment heretofore described except defined in the affixed claim.

What is claimed is:

1. A coating device for cold bottles or like containers, characterized in that a conveyer is provided for transporting cold bottles or like containers, a bottle rotating means is provided on one side of line of cold bottles or like containers which are transported by the conveyer, said rotating means comprising a bottle drive belt which moves in parallel to the direction of transportation of the conveyer and in contact with the cold bottles or like containers, an air spraying station and a coating fluid application station are sequentially disposed on other side of the line of containers, compressed air jet nozzles are disposed on at least two levels at the air spraying station, said jet nozzles being directed to predetermined portions to be coated on the containers, coating fluid application rolls are disposed on at least one levels at the coating fluid application station, said application rolls rotating about axes parallel to the direction of transportation of the containers and in contact with the containers, said application rolls being supplied with coating fluid transferred from spray nozzles through sponge rolls which rotate in contact with the application rolls.

2. A coating device for cold bottles or like containers according to claim 1, characterized in that fluid flow system is provided by which coating fluid is supplied from a fluid tank, routed through a fluid feed line, a solenoid valve and feed headers and injected onto said sponge rolls through said spray nozzles, said fluid feed line being provided with a solenoid valve which can be controlled by a timer.

3. A coating device for cold bottles or like containers according to claim 1, characterized in that said coating fluid application roll is a resilient roll comprising felt plates cut in circular discs and stacked in a cylindrical shape.

4. A coating device for cold bottles or like containers according to claim 1, characterized in that said cold bottles or like containers are positioned on said conveyer while constrained so that about one third of the bottom portion of each bottle protrudes from the side of the conveyer in progress.

5. A coating device for cold bottles or like containers according to claim 1, characterized in that spring loaded pressing rolls are provided for pushing said bottles or like containers against said coating fluid application rolls under uniform pressure.

* * * * *